United States Patent [19]

Gysin

[11] Patent Number: 4,750,422

[45] Date of Patent: Jun. 14, 1988

[54] WATER FORM ROLLER AND METHOD OF MAKING THE SAME

[76] Inventor: Max Gysin, 11 Hidden Harbor Dr., Babylon, N.Y. 11702

[21] Appl. No.: 819,998

[22] Filed: Jan. 21, 1986

[51] Int. Cl.[4] ..... B41F 7/26; B41N 7/04; B41L 25/02

[52] U.S. Cl. ..... 101/426; 101/148; 29/127

[58] Field of Search ..... 101/148, 147, 348, 426; 29/127, 128, 124, 125, 131, 130, 121.4, 121.5

[56] References Cited

U.S. PATENT DOCUMENTS 1,370,709 3/1921 Smith ..... 29/130 X 2,429,670 10/1947 Crews ..... 29/127

2,690,119 9/1954 Black ..... 101/148

FOREIGN PATENT DOCUMENTS

WO80/01151 6/1980 PCT Int'l Appl. ..... 101/147

*Primary Examiner*—J. Reed Fisher

*Attorney, Agent, or Firm*—Bauer & Schaffer

[57] ABSTRACT

A water form roller for evenly distributing and spreading liquid over a printing surface in which the roller has a circular surface formed by a plurality of helically interwound rubber compounds of different durometers bonded together to form a monolithic roller free of separations, and a method of making the same.

15 Claims, 1 Drawing Sheet

WATER FORM ROLLER AND METHOD OF MAKING THE SAME

This invention relates to a water form roller also known in printing as a "Barback" roller, and to a method of making the same.

BACKGROUND OF THE INVENTION

Water form or Barback rollers are used in the printing industry to spread water over a printing plate as evenly and as thinly as possible to enable the printing plate to produce a better printed image. When water and/or other liquids are distributed over the printing plate, it covers those areas of the plate that bear printing images to which ink is applied for printing as well as those areas that are free or devoid of printing images and are intended to be free of print. If the water or other liquid is applied and spread too thickly or too unevenly, printing is adversely affected and the printed image that is produced is often unacceptable.

The present roller provides a roller surface that is comprised of two rubber or rubber-like compounds of different durometers. The compounds are interwoven at the roller surface in a helical direction to cause the liquid to flow in a lateral direction over the surface of the printing plate, thereby assuring that the whole of the printing plate is covered by the liquid. During such forced flow of liquid the portion of the roller surface that is of softer durometer tends to yield under the pressure of the liquid thereagainst and forms a duct along which the liquid is helically conducted and deposited on the surface of the printing plate. At the same time, the helical portion of the roller surface that is of harder durometer and is less yielding engages and presses against the surface of the printing plate and wipes the deposited liquid so as to spread it evenly and thinly over the printing plate surface.

Obviously, the durometer of one of the interwoven compounds may be selected to be more or less yieldable to provide for the conduct of more or less of the liquid to the printing plate surface as is desired. Similarly, the hardness and less yieldability of the wiping or spreading one of the compounds may be selected to provide greater rigidity of a desired stiffness for wiping engagement with the printing plate. If the ductor or conductor compound is more yieldable, it will conduct more liquid to the printing plate. If the wiping compound is selected to be of a harder durometer, it may wipe and spread the deposited liquid thinner against the surface of the printing plate.

Rollers having helices have been taught before and are exemplified in the U.S. Pat. Nos. 828,241 to Peterson, 945,411 to Peterson, 1,079,339 to Hennessey, 1,547,060 to May, 2,689,522 to Curtis, 2,690,119 to Black, 2,996,981 to Reinartz et al, and 3,651,758 to Harrod. None of the aforementioned prior art patents have recognized or taught the use or the construction of a monolithic roller having a plurality of surfaces that are formed of different materials, each of which has a different durometer for the purpose of alternately conducting and wiping a liquid on the surface of a printing plate or other surface, nor have any of them taught the method of making such a roller.

The above description, as well as further objects, features, and advantages of the present invention, will be more fully appreciated by reference to the following detailed description of a presently preferred, but nonetheless illustrative, embodiment in accordance with the present invention when taken in conjunction with the accompanying drawings, wherein:

DESCRIPTION OF THE INVENTION

Figure 1:
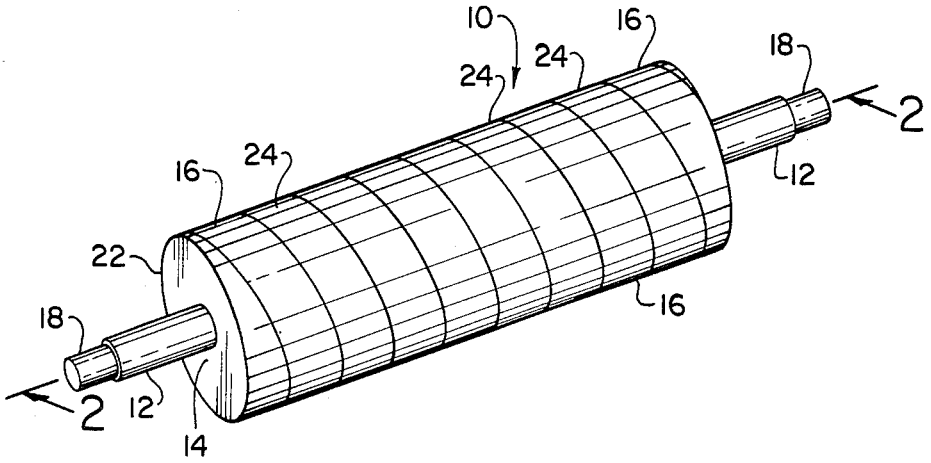
FIG. 1 is a perspective view of a roller constructed according to the present invention.
Figure 2:
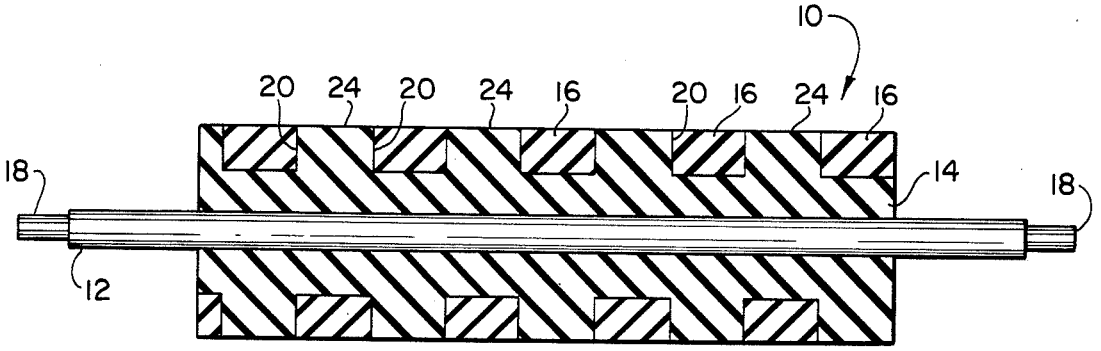
FIG. 2 is a vertical cross-section of FIG. 1 taken along lines 2—2.

Referring now to FIGS. 1 and 2 of the drawings, the water form roller is generally identified by the numeral 10 and includes a conventional metal core 12 that is generally mounted for rotation in the printing machine. Since the printing machine does not form any part of the present invention, the structural details of the same are omitted from the present drawing and description.

The roller 10 may be of any required elongation and length and of any required or predetermined diameter. It is illustrated in the drawing as being composed of at least two separate elements that are helically interwound in the finalized or finished construction. As the description proceeds it will be clear that although only two such separate elements are disclosed and described, reference to a plurality of such elements should make it clear that more than two can also be utilized within the scope of the teaching of the present invention.

One of the plurality of separate elements 14 is shown mounted about and bonded directly to the core 12. As such, the element 14 provides a built-up body of selected elongated length for supporting at least a second element 16 that is helically interwound therewith as is illustrated in the drawing. The elements 14 and 16 each are of different durometers even though they may be made of the same or similar rubber or rubber-like compouns. Thus, it is possible that one of the elements 14 or 16 may be of a rubber compound and the other of the elements may be of a rubber-like compound without actually being rubber, but each having a different durometer than the other. Thus, it is possible that one of the elements may be rubber and the other element may be a synthetic material that may have the same or similar characteristics as rubber and which will vulcanize to the rubber when the same is subjected to a vulcanization process.

In practice, the core 12 is held at its opposite ends 18 in a lathe-type machine and rotated in the machine while the compound 14 is extruded hot from an extrusion machine (not shown). As the compound 14 exits from the extrusion machine, it is helically wrapped about the outer surface of the core 12. Because the compound 14 is taken hot from the extruding machine while it is wrapped into engaging contact with the core surface, it will adhere directly to the core surface when it cools. As a result, the compound element 14 and the core surface 12 will become unitary and monilithically inseparable as a single structure.

An amount of the element or compound 14 is applied to the roller core sufficient to build the body of the material 14 to a desired diameter. To assure that the turns of the compound 14 are monolithically bonded together such that the touching sides thereof are nonporous, free of blemishes and spaces, unitary and inseparable, the composite structure is subjected to a step of vulcanization. Such vulcanization step is conventional and is usually performed by steam pressure.

This vulcanization step cures the body 14 to melt it and thereby cause it to flow to eliminate all spaces within the body which includes the elimination of all blemishes, openings, separations, and melds and blends together the sides of the helical turns of the element 14 so as to eliminate all visible evidence of the turns. As a consequence, the body 14 becomes a monolitic unitary structure free of any separations or evidence of any helical turns. It also assures that the body 14 and the core 12 are bonded together as a single structure as is seen in FIG. 2. Thereafter, the outer circular surface of the body 14 may be ground to a desired diameter.

The roller 10 is thereafter prepared to receive the second rubber or rubber-like compound element 16. To do this, the body 14 is ground with a helical groove which forms a locating means in the outer surface 22 of the body 14. The depth of the locating means or groove 20 is generally about one-eight of an inch, sufficient to locate and retain the second element 16 therein. It has been found that the depth of the groove may be shallower than that indicated for smaller diameter rollers intended for lighter usage and may be made deeper for larger diameter rollers intended for heavier or more demanding use.

The width of the helical groove 20 should be such as to receive the element 16 snugly therein without substantial deformation of either of the elements 14 or 16. Therefore, the width and depth or thickness of the element 16 should correspond substantially to the size of the groove 20 as described. The formation of the helical groove 20 results in the production of a helically directed continuous ridge or projection 24 which is a unitary and monolithic part of the body 14 and extends uninterruptedly from one end of the roller 10 of the body 14 to the other end.

The element 16 is then inserted into the groove 20 and interwound helically and circumferentially about the body 14 and snugly between the turns of the helical projection 24 after the proper formation and provision of the groove 20 in the body 14. The height of the element 16 is unimportant since it may extend radially beyond the radial extent of the helical groove 20 and even also radially beyond the helical projection 24 as long as it fits snugly within the groove 20. To this extent, the sides of the helically interwound element 16 will engage with the groove defining sides of the helical projection 24 while its base or inner surface will seat against the base surface of the groove 20. This will help to assure that the element 16 will be fully and completely bonded to the body 14 and to its helical projection 24.

The whole roller is thereafter subjected to a further step of conventional steam vulcanization. This final steam vulcanization now fully and completely bonds the compound element 16 and the groove 20 and with the base of the groove thereof and also fully and completely at its engaged sides with the groove defining sides of the projection 24. This final vulcanization, coupled with the initial vulcanization, eliminates fully all separations between the insert element 16 and the body 14 and the projections 24. It produces a unitary roller that is fully free of all blemishes, all pores, all separations, and that is so completely monolithic in construction as is illustrated in FIG. 2 as to fully eliminate any of the helical lines that may have resulted during the helical wrapping formation of the body 14 about the core 12.

Figure 3:
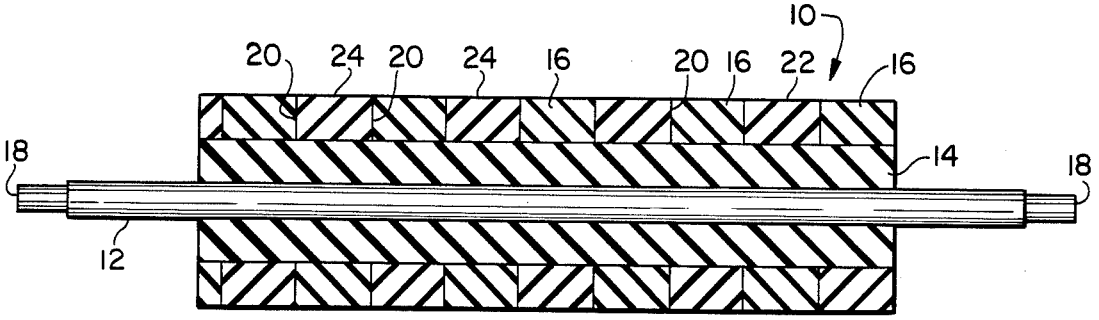
FIG. 3 is a vertical cross-section similar to FIG. 2 of another embodiment of the invention.

It is also within the contemplation of the invention that the second separate element 16 may be helically interwound simultaneously with the helical winding of the projection 24. This may be done as is illustrated more fully in FIG. 3. For example, the body 14 may be initially wrapped about the core in the manner previously described. It may also be vulcanized directly to such core 12 in the manner as previously described. Thereafter, the two separate compound elements 24 and 16 may be wrapped side by side simultaneously and concurrently circumferentially about the body 14 to either the full longitudinal extent of the body as is shown in FIG. 3 or for a shorter length thereof, if desired. Thereafter, both elements 16 and 24 may be vulcanized to the body 14 in a manner to be described.

FIG. 3 is used to illustrate that the body 14 can also be wound about the core in the manner previously described and that during such winding the helically spaced projection 24 may be initially provided with the groove 20 therebetween. This means that during the helical wrapping of the body element 14 the projecting helical portion 24 thereof may then be spaced so as to provide the space or groove 20 between the sides of the turns thereof. Such space may then be deemed to be the equivalent of the groove 20 previously described with respect to the embodiment shown in FIG. 2.

After the groove 20 is provided in the embodiment of FIG. 3, the insert element 16 may be helically interwound with the helical projection 24 into the space 20 in side-by-side engagement with the sides of the projection 24 in the same manner as was previously described. Because of the similarities of the teachings of the inventive embodiment 2 and 3, the same identifying numerals have been used so that correlation between the two embodiments can be continued without misunderstanding.

The final vulcanization may be performed in the same manner as was previously described, in the event the teaching of the embodiment of FIG. 3 is utilized. That is to say, the whole of the roller containing the interwound elements 16 and 24, whether they be separate from the body 14 or with the projection 24 provided as part of the body 14, the same may then be subjected to the final steam vulcanization bonding step as previously described. Such step will produce the same effect in the embodiment of FIG. 3 as it produces in the teaching of the embodiment of FIG. 2 in the manner as discussed above.

Following the completion of the final vulcanization step, the outer surface may now be finished or ground to a desired size or diameter. During the final grinding or finishing of the outer surface of the roller 10, whatever differences in radial imperfections that may have existed between the interwound element 24 and the insert element 16 is now eliminated with the resultant uniform finishing of the roller 10 to a desired diameter.

As previously noted, the two different rubber or rubber-like compounds or elements 14 and 16 or 16 and 24, as the case may be, are of different durometers. For example, it has been found that the projection 24 may be formed of a material having a selected durometer of between 15 and 35, while the insert element 16 may also have a selected durometer of between 15 and 35. However, it has been found more desirable to make one of the elements 16 or 24 of a relatively softer diameter than that of the other element, such that the softer durometer element may function as a ductor or conductor of the liquid to the printing plate surface.

Hence, in certain instances the helical projection 24 may have a selected durometer as hard as 35 while the element 16 may have a selected durometer as soft or as yieldable as 15. If, in practice, it is found that more liquid is required to be conducted to the printing plate surface, then a softer durometer for the element 16 can be selected. If less liquid is to be conducted, then the hardness of the element 16 can be increased selectively. The same is also true of the projection 24. If it is required to wipe and spread and distribute the liquid evenly and thinly over the printing plate with greater stiffnes, then a harder durometer will be selected as compared to a lower or more yieldable durometer.

Although the element 16 has been described as the ductor part of the roller 10 and the helical projection as the wiper, it should be apparent that the same was made for ease of description only and was not intended to be a limitation upon the scope of the present invention. There is nothing in the structure of the roller 10 which inhibits or prevents either element 24 or 16 from performing either the ductor or wiping functions. Therefore, either one or the other of the elements 16 and 24 may be of a durometer that permits it to function as the liquid conductor while the other, being of a different durometer, will permit it to function as the liquid spreader and wiper to distribute the liquid evenly and thinly over the printing plate surface to a desired extent.

Each of the elements 14, 16, and 24 has been referred to as "rubber-like" to indicate that the same may have characteristics of rubber without in fact being rubber. It is possible that certain plastic materials may be equally applicable for use within the scope and teaching of the present invention. Thus, while the illustrated and preferred embodiments of the invention have been described, it is to be understood that variations and modifications are possible within the scope and teaching of the invention and the same is not intended to be limited to the precise details set forth hereinbefore.

While there have been shown and described and pointed out the fundamental novel features of the invention as applied to a preferred embodiment thereof, it will be understood that various omissions and substitutions and changes in the form and details of the device illustrated and in its operation may e made by those skilled in the art without departing from the spirit of the invention. It is the intention, therefore, to be limited only as indicated by the scope of the claims appended hereto.

What is claimed is:

1. In a water form roller having an outer surface and a roller core, a first rubber element mounted to said core and forming a part of said outer surface said first element being elongated in length and having a predetermined durometer hardness, a second rubber element hellically interwound with said first element and forming a part of said outer uniform surface and having a durometer hardness different than that of said first element, said first and second elements being bonded inseparable and monolithic with each other free of separations therebetween to form the whole of said outer surface, and said monolithic helically interwoven elements forming said outer surface of substantially uniform diameter.

2. In a roller element as in claim 1, a body mounted on said core and said first and second elements being formed circumferentially about said body of at least two helically wound strips of rubber material with the sides of said first and second elements in touching engagement, and being vulcanized and bonded with the sides of said elements forming a unitary roller that is monolithic and without separations.

3. In a roller element as in claim 2, said first and second elements each being of a durometer hardness different from that of the other.

4. In a roller as in claim 2, said body being formed of a helical winding forming in which the helical turns are relatively spaced longitudinally from each other to form said first element, said second element being helically directed and interwound with said first element in the space defined between the turns of said first element and in side-by-side touching engagement therewith and bonded thereto along said touching sides to form a monolithic roller without separations between said touching sides.

5. In a roller as in claim 4, said space between said first element being a helical groove defined in said body and into which a second element is bonded.

6. In a roller as in claim 5, said first element having a durometer, and said second element having a durometer hardness different from the durometer hardness of said first element.

7. A water form roller comprising a roller core, a monolithic roller body having an outer surface formed only of a plurality of helically interwound rubber elements of different durometer hardness, and said monolithic roller body, said roller core and said element being bonded together by vulcanization without separation therebetween.

8. A water form roller as in claim 7, one of said elements having a helical groove therein, and another of said elements being interwound with said one element within said helical groove and bonded inseparable thereto as a monolithic part of said roller body.

9. A water form roller as in claim 8, the durometer hardness of one element being different than that of the other element.

10. A water form roller comprising a monolithic body having an outer surface of substantially uniform diameter comprised of a plurality of only rubber compounds, said compounds being interwoven with each other and being of different durometer hardness, said compound of softer durometer hardness yielding in response to the pressure of liquid thereagainst to form areas in which the liquid flows, said other compound of greater durometer hardness serving to compress the deposited liquid against the surface on which the liquid is deposited, and said compounds being interwoven in helical directions and bonded together by vulcanizing them to form said monolithic body.

11. The method of making a water form roller having an outer surface comprising applying a first rubber element of a selected durometer hardness in helical turns about a roller core, applying a second rubber element of a selected durometer hardness about the roller core and interwoven with the helical turns of the first element, bonding the two elements together to form a monolithic body of the helical turns free of separations, blemishes, and pores, and finishing the first and second rubber elements to a selected diameter to form the outer surface.

12. The method as in claim 11, bonding the first element to the roller core and forming a helically directed groove therein and interwinding the second element in the groove.

13. The method as in claim 11, bonding the first element to the rubber core before applying the second element between the turns of the first element.

14. The method as in claim 13, bonding the first and second elements together after bonding the first element to the roller core.

15. The method as in claim 11, bonding the two elements together by vulcanization.

* * * * *